US010107552B2

(12) United States Patent
Kleinpass et al.

(10) Patent No.: US 10,107,552 B2
(45) Date of Patent: Oct. 23, 2018

(54) HOLDING DEVICE FOR A HEATING ELEMENT, AND HEATER

(71) Applicant: PLANSEE SE, Reutte (AT)

(72) Inventors: Bernd Kleinpass, Pfronten (DE); Peter Mallaun, See (AT)

(73) Assignee: Plansee SE, Reutte (AT)

( * ) Notice: Subject to any disclaimer, the term of this patent is extended or adjusted under 35 U.S.C. 154(b) by 250 days.

(21) Appl. No.: 14/771,268

(22) PCT Filed: Feb. 27, 2014

(86) PCT No.: PCT/AT2014/000039

§ 371 (c)(1),
(2) Date: Aug. 28, 2015

(87) PCT Pub. No.: WO2014/131069

PCT Pub. Date: Sep. 4, 2014

(65) Prior Publication Data

US 2016/0018163 A1 Jan. 21, 2016

(30) Foreign Application Priority Data

Mar. 1, 2013 (AT) ..... GM70/2013

(51) Int. Cl.

| | |
|---|---|
| ***H05B 3/03*** | (2006.01) |
| ***F27D 11/02*** | (2006.01) |
| ***F27D 99/00*** | (2010.01) |
| ***F27D 11/10*** | (2006.01) |
| ***H05B 3/08*** | (2006.01) |
| ***H05B 3/66*** | (2006.01) |
| *F27D 1/00* | (2006.01) |

(52) U.S. Cl.

CPC ..... *F27D 99/0006* (2013.01); *F27D 11/02* (2013.01); *F27D 11/10* (2013.01); *H05B 3/08* (2013.01); *H05B 3/66* (2013.01); *F27D 2001/0079* (2013.01); *F27D 2099/0008* (2013.01); *H05B 2203/016* (2013.01)

(58) Field of Classification Search

None

See application file for complete search history.

(56) References Cited

U.S. PATENT DOCUMENTS 3,855,453 A 12/1974 Manning et al.
4,015,105 A * 3/1977 Dunn ..... H05B 3/14 219/548

(Continued)

FOREIGN PATENT DOCUMENTS

CN 1146706 4/1997
CN 2896172 Y 5/2007

(Continued)

*Primary Examiner* — Joseph M Pelham

(74) *Attorney, Agent, or Firm* — Laurence A. Greenberg; Werner H. Stemer; Ralph E. Locher

(57) ABSTRACT

A holding device for a heating element and a heater with at least one such holding device. The holding device is produced from a refractory metal or from an alloy on the basis of refractory metal, has at least two holding elements which are arranged perpendicularly or at least substantially perpendicularly to each other. A first holding element is at least partially arranged in an opening of a second holding element.

17 Claims, 3 Drawing Sheets

(56) References Cited

U.S. PATENT DOCUMENTS

| | | | | |
|---|---|---|---|---|
| 4,021,769 | A * | 5/1977 | Edin | H01C 3/14 219/548 |
| 4,259,538 | A * | 3/1981 | Jones | H05B 3/66 373/112 |
| 4,392,052 | A | 7/1983 | Magnusson et al. | |
| 4,503,319 | A | 3/1985 | Moritoki et al. | |
| 4,755,658 | A | 7/1988 | Wilsey | |
| 4,856,022 | A | 8/1989 | Jones | |
| 5,157,242 | A | 10/1992 | Hetherington et al. | |
| 5,575,582 | A | 11/1996 | Frastaci et al. | |
| 7,044,399 | B2 | 5/2006 | Goto et al. | |
| 8,728,385 | B2 | 5/2014 | Vegge et al. | |
| 2004/0238526 | A1 | 12/2004 | Leycuras | |
| 2006/0083941 | A1* | 4/2006 | Lorenz | G01F 1/8404 428/544 |
| 2013/0216927 | A1* | 8/2013 | Gottmann | H01M 8/2465 429/431 |

FOREIGN PATENT DOCUMENTS

| | | | |
|---|---|---|---|
| CN | 102159734 | | 8/2011 |
| CN | 202514099 | U | 10/2012 |
| FR | 2826541 | A1 | 12/2002 |
| GB | 943128 | A | 11/1963 |
| JP | H07288178 | A | 10/1995 |
| JP | 2004171834 | A | 6/2004 |
| JP | 2005085697 | A | 3/2005 |

* cited by examiner

HOLDING DEVICE FOR A HEATING ELEMENT, AND HEATER

BACKGROUND OF THE INVENTION

Field of the Invention:

The invention relates to a holding device for a heating element and to a heater with at least one such holding device, in particular a tungsten heater.

CN 2896172 U discloses a heater for a high-temperature furnace for sintering tungsten or molybdenum. The heater is of cylindrical design and has a plurality of heating elements in the form of suspended nets. The nets are each fastened in the furnace by means of a holding device. The holding device is produced from a bevelled plate which engages around the upper end of the nets in a Y shape. A further plate is arranged between the ends of the bevelled plate, said further plate being riveted to the ends of the bevelled plate.

BRIEF SUMMARY OF THE INVENTION

It is an object of the invention to provide a holding device for a heating element and a heater with such a holding device, which holding device and heater can be produced cost-effectively and are stable in use.

This object is achieved by the features of 11 the claims.

Advantageous refinements are the subject matter of the dependent claims.

As claimed, a holding device is provided for a heating element, in particular for use in a tungsten heater. The holding device is produced from a refractory metal or from an alloy on the basis of refractory metal, and therefore said holding device withstands high temperatures and remains dimensionally stable even at high temperatures. A refractory metal or an alloy on the basis of refractory metal refers to metals or alloys which have a melting point of greater than or equal to 1772° C. (corresponding to the melting point of platinum). The holding device has at least two holding elements which are arranged perpendicularly or substantially perpendicularly to each other. For example, a heating element in the form of a net or braided material is fastenable to or is held on a holding element, and the holding device (with the heating element) is fastenable in a furnace chamber by means of the further holding element. That is to say, a heating element can be held or fastened in a furnace chamber by means of the holding device. The two holding elements are connected to each other, wherein one of the two holding elements has an opening or a (through) hole, in which at least part of the other holding element is arranged or is inserted. For example, the opening is (four) cornered or is round, depending in each case on the design of that part of the holding element which is pushed into the opening. A simple and stable connection is thus provided at the location of the mechanical stressing (i.e. at the location of the connection of the two holding elements). In particular, for example, instead of bevelled plates which are mechanically less stable, as described above with regard to CN 2896172 U, use can be made of solid material having larger cross sections, and therefore a stable holding device which can be produced simply and rapidly is provided.

A first holding element is preferably at least partially arranged in an opening of a second holding element, wherein the first holding element is connected to the second holding element by means of deformation. That is to say, the two holding elements are connected to each other at a temperature significantly below the recrystallization temperature. In an exemplary production method, the first holding element is inserted into the opening of the second holding element such that said first holding element protrudes on the opposite side of the second holding element. In a subsequent step, the protruding part is cold-deformed, for example by means of tumbling, and therefore the two holding elements are securely connected to each other.

Due to welding or due to the high local temperatures during a welding operation, microcracks and structural embrittlement can occur at the location of the weld seam. In order to prevent this, the first and the second holding elements are particularly preferably not welded to each other.

According to one refinement, the holding device is current-conductive, and therefore said holding device can additionally be used as a current connection for a heating element which is fastenable to the holding device.

At least one of the holding elements is preferably designed as a single part or is produced from a solid material, i.e. not from a plate. For example, at least one holding element is designed in the form of a bar, a square profile or a polygonal profile. As a result, the mechanical stability of the individual holding elements and therefore of the holding device is increased. Furthermore, the production of the holding elements is simplified, since they can be produced simply and rapidly, for example by cutting bar stock to size. The two holding elements are particularly preferably formed from a solid material.

The holding device is particularly preferably fastenable in a furnace chamber by the first holding element, for example by means of screws or a clamping connection between the first holding element and the furnace chamber. That is to say, if a heating element, such as, for example, a tungsten net or plate, is fastened in a suspended manner, for example, to the holding device (or to the second holding element), then the entire weight of the holding device and of the heating element is suspended on the first holding element. Alternatively, a heating element, for example in the form of a plate, is arranged upright on the holding device, wherein the weight of the holding device and of the heating element likewise acts on the first holding element.

According to one refinement, the holding device has a third holding element which is fastened to the second holding element, i.e., when the holding device is used, a heating element, such as, for example, a tungsten net, is fastened to the third heating element, for example is welded to the third heating element. By means of the use of a third heating element, the dimensions of which are matched to the heating element used in each case, the first and second heating elements can be produced irrespective of the dimensions of the heating element used. That is to say, according to the 'modular principle', in one production step a multiplicity of identical units consisting of the first and second heating elements can be produced, said units subsequently being able to be adapted to the corresponding use or to the corresponding heating element by the fastening of the correspondingly dimensioned or configured third heating element. For example, the third heating element can be adapted to a cylindrical or angular furnace chamber or heater, i.e. the third holding element can be of curved or rectilinear design or can have any other shape which is matched to the respective use.

The second and third heating elements are preferably connected to each other by means of at least one form-locking and/or force-fitting connecting means, for example by means of rivets or screws. The second and third heating elements are particularly preferably not connected to each other in an integrally bonded manner, for example are not welded to each other. That is to say, the above-described disadvantages of welding are circumvented by a connection, for example by means of rivets.

The holding device or the first, second and third holding elements is or are particularly preferably formed from tungsten or an alloy on the basis of tungsten. An alloy on the basis of tungsten is an alloy with a proportion of tungsten of ≥50% by weight. The alloy on the basis of tungsten preferably has a proportion of tungsten of ≥90% by weight. In this refinement, the holding-element connection as described above is particularly advantageous, since tungsten has a tendency to become brittle and therefore can be connected only with difficulty by means of conventional connecting technologies (such as, for example, welding).

According to claim 11, a heater, for example a tungsten heater, with at least one holding device as described above and below, is provided, wherein the at least one holding device is connected to at least one heating element in a current-conductive manner.

Individual features of the above-described refinements of the holding device and of the heater, and individual features of the holding device described in the following exemplary embodiment can be combined with one another arbitrarily.

BRIEF DESCRIPTION OF THE SEVERAL VIEWS OF THE DRAWING

An embodiment of the invention is explained in more detail with reference to the figures, in which.

DESCRIPTION OF THE INVENTION

Figure 1A:
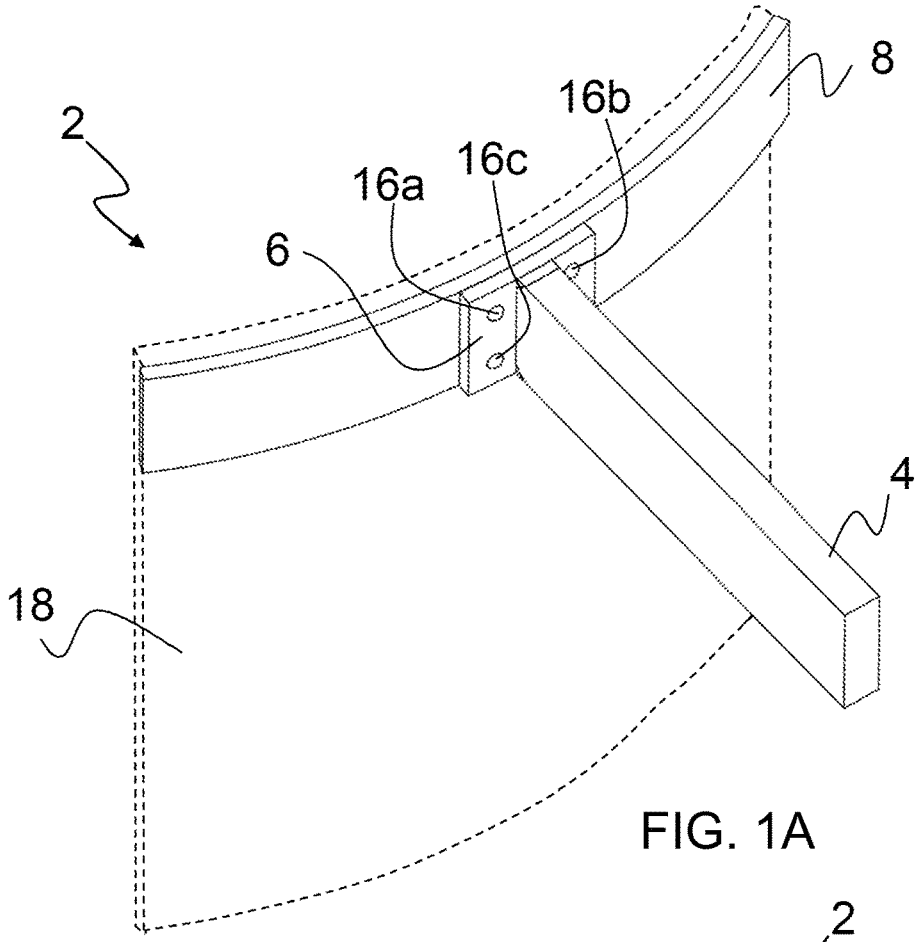
FIGS. 1*a-b* show perspective views of a holding device.
Figure 1B:
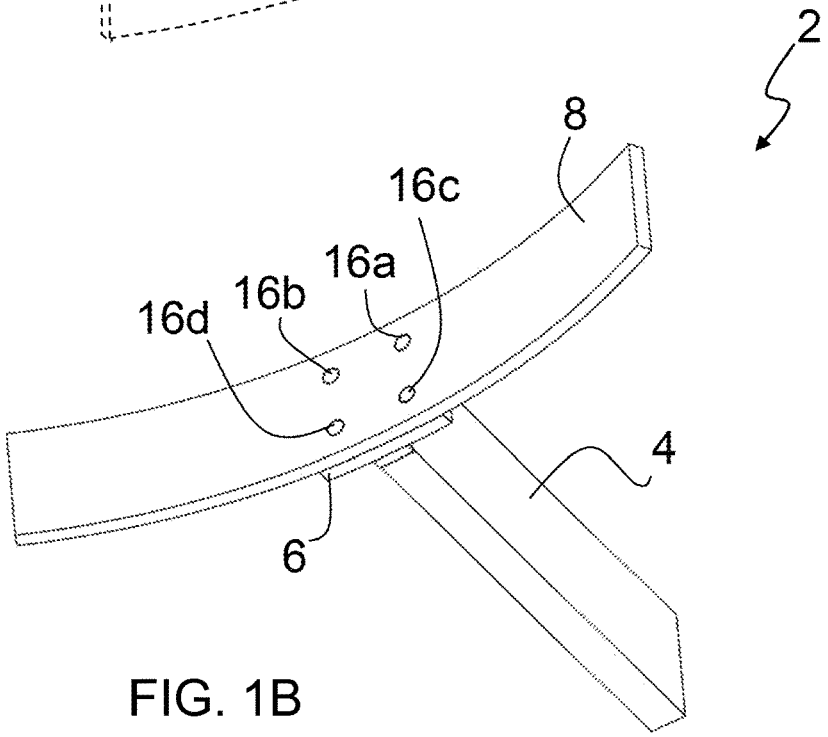

FIGS. 1*a-b* show perspective views of a holding device 2 according to a preferred refinement. The holding device 2 is formed from a first, second and third holding element 4, 6, 8, which holding elements are connected to one another and are produced from a refractory metal or an alloy on the basis of refractory metal, for example tungsten or molybdenum. The holding device 2 is current-conductive and is used for the current supply of a heating element 18 (or more than one heating element 18), which heating elements can be fastened to the holding device 2 (in a suspended manner). The heating element 18 which is illustrated in sketched form in FIG. 1a is formed, for example, from a tungsten net, a plate or a multiplicity of wires (running vertically).

When the holding device 2 is used, the holding device is fastened in a furnace chamber (not illustrated), by fastening of the first holding element 4 or of the support in the furnace chamber, for example, by means of a clamping connection or by means of screws. That is to say, after the installation, the holding device 2 or the heating element 18 is arranged in the furnace chamber in a suspended manner (on the first holding element 4). The heating element 18 is fastened to the third holding element 8, for example by means of a clamping connection and/or welded joint, in order to ensure good electrical contact.

Figure 2:
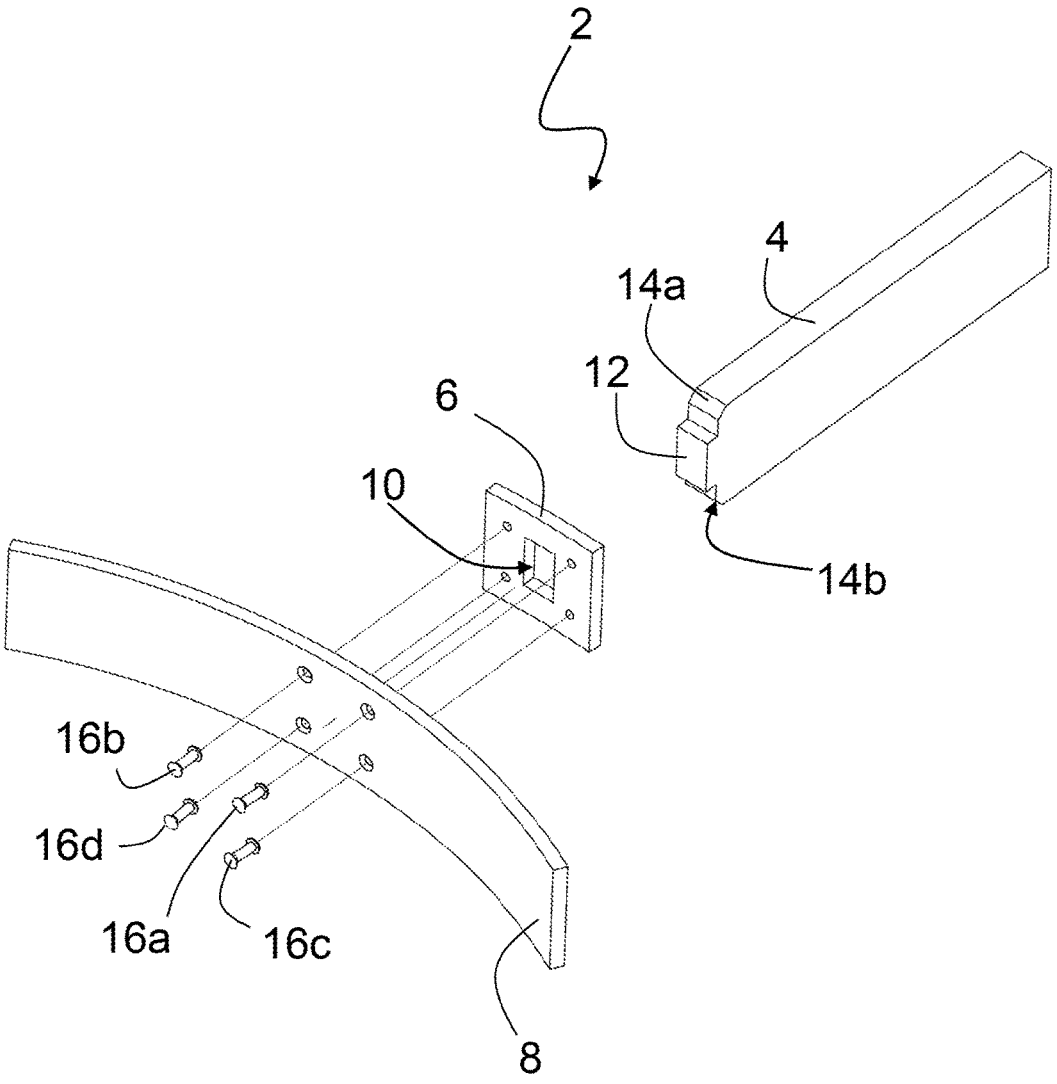
FIG. 2 shows an exploded view of the holding device of FIGS. 1*a-b.

FIG. 2 shows an exploded view of the holding device 2 from FIG. 1 in order to illustrate the connection of the three holding elements 4, 6, 8. The holding elements 4, 6, 8 are produced from solid material or are produced not by bevelling plates. The first holding element 4 has, at one end, a pin 12 which is inserted into a correspondingly designed opening 10 in the second holding element 6. The pin 12 is subsequently deformed by means of cold deformation, such as, for example, tumbling, and therefore the first and second holding elements 4, 6 are securely connected to each other.

After the connection of the first and second holding elements 4, 6, the third holding element 8 is connected to the second holding element 6 by means of four rivets 16*a-d.*

That is to say, in this refinement of the holding device 2, the individual elements do not need to be welded, and therefore the disadvantages of welding (microcrack formation, structural embrittlement) can be circumvented.

Two bevels 14*a-b* can optionally be arranged on the first holding element 4, said bevels, after the plugging together, lying adjacent to the second holding element 6. The bevels 14*a-b* can receive a weld seam in order additionally to secure the connection between the two holding elements 4, 6, wherein the location of the weld seam lies outside or substantially outside the location of the mechanical loading during the use of the holding device. That is to say, the weld seam or weld seams are sufficiently spaced apart from the connection (opening 10/pin 12) between first and second holding elements, and therefore the welding does not have any negative effect on the connection.

Figure 3A:
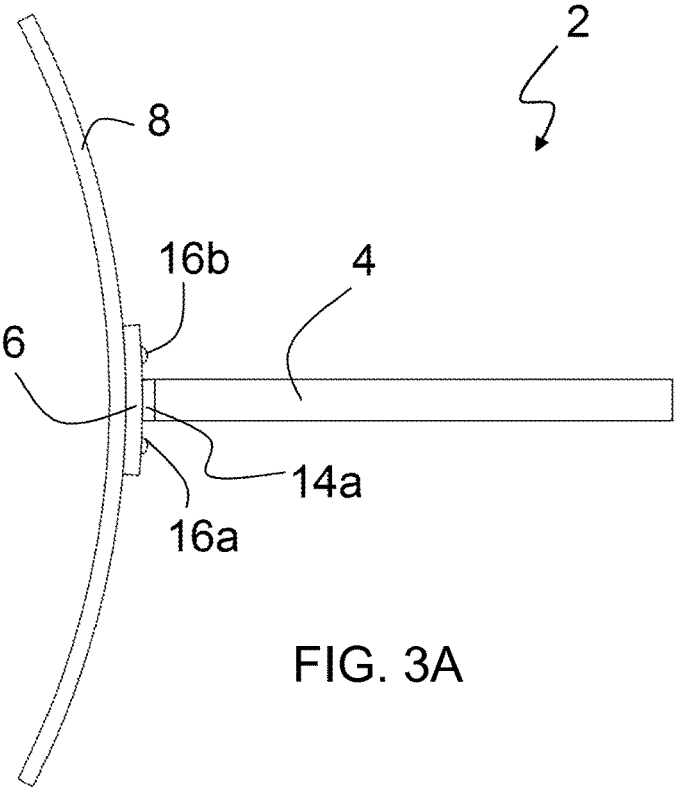
* and FIGS. 3*a-c* show side views and a top view of the holding device from FIGS. 1*a-b*.
Figure 3B:
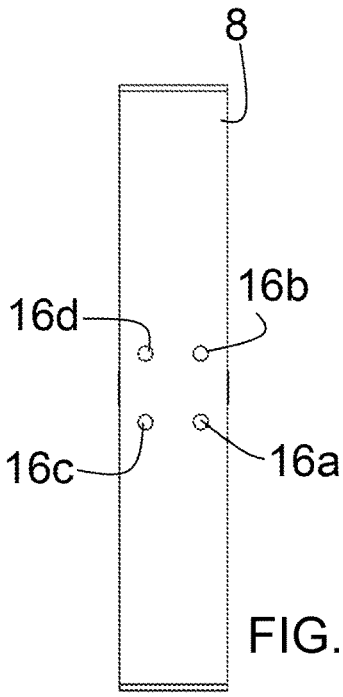
Figure 3C:
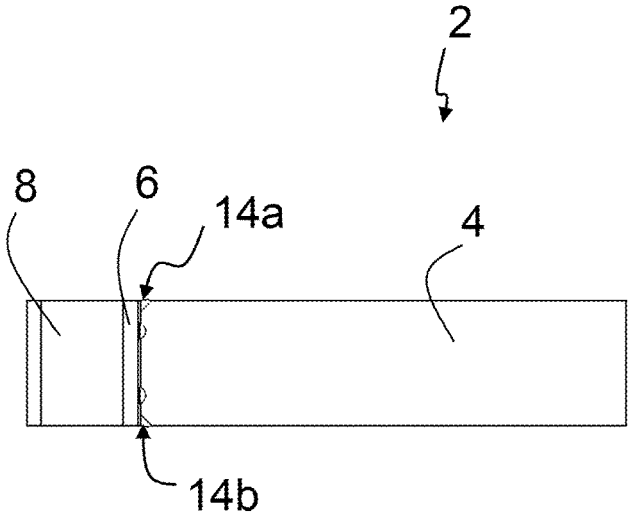

FIGS. 3*a-c* show side views and a top view of the above-described holding device 2. The exemplary holding device 2 is designed for use in a cylindrical furnace chamber; in particular, three of the depicted holding devices 2 are required in order therefore to heat a cylindrical furnace chamber by means of the corresponding heating elements 18. For this purpose, at least the third holding element 8 or the heating element support is produced from a bent plate, the curvature of which is matched to the dimensions of the furnace chamber.

A furnace chamber can have any cross section, for example rectangular, oval, etc. The third holding element 8 can correspondingly be matched to the different dimensions of the furnace chamber and of the heating elements. That is to say, during the production of the holding device, first of all units consisting of the first and second holding elements can be produced, for example, before actually being required. The holding device is matched to the corresponding dimensions of a furnace chamber and of a heating element only with the fastening of the correspondingly dimensioned third holding element, i.e. the third holding element has, for example, a certain curvature and a certain length. Since the third holding element 8 can be connected in a simple and rapid manner to the second holding element 6 by means of rivets 16a-d, holding devices 2 can thereby be adapted according to the 'modular principle' rapidly and simply to the respective use.

According to an alternative refinement which is not illustrated here, the holding device is only produced from a first and second holding element, wherein the second holding element is designed or has corresponding dimensions for the fastening of a heating element 18 thereto.

LIST OF REFERENCE NUMBERS

2 Holding device
4 First holding element
6 Second holding element
8 Third holding element
10 Opening
12 Pin
14*a-b* Bevel
16*a-d* Rivet
18 Heating element

The invention claimed is:

1. A holding device for a heating element, the holding device comprising:

a refractory metal or an alloy based on refractory metal;

at least two holding elements including a first holding element and a second holding element arranged perpendicularly or substantially perpendicularly to one another;

said first holding element being at least partially arranged in an opening formed in said second holding element; and said first holding element includes a deformation fastening said first holding element to said second holding element.

2. The holding device according to claim 1, wherein said deformation is a cold deformation.

3. The holding device according to claim 1, wherein said first and second holding elements are not welded to each other.

4. The holding device according to claim 1, wherein the holding device is a current-conduction element.

5. The holding device according to claim 4 configured to form a current connection for a heating element that is fastenable to the holding device.

6. The holding device according to claim 1, wherein at least one of said holding elements is formed as a single part.

7. The holding device according to claim 6, wherein said single part has a form selected from the group consisting of a bar, a square profile and a polygonal profile.

8. The holding device according to claim 1, wherein said first holding element is configured for fastening the holding device in a furnace chamber.

9. The holding device according to claim 1, which further comprises a third holding element fastened to said second holding element.

10. The holding device according to claim 9, wherein said second and third holding elements are connected to one another by way of a form-locking and/or force-fitting connection.

11. The holding device according to claim 10, wherein said second and third holding elements are not connected to one another in an integrally bonded manner.

12. The holding device according to claim 9, wherein said second holding element or said third holding element is configured to fasten a heating element suspended therefrom.

13. The holding device according to claim 12, wherein said heating element suspended from said second or third holding element is at least one meshwork, at least one plate, and/or a multiplicity of wires.

14. The holding device according to claim 1, formed of tungsten or of an alloy based on tungsten.

15. A heater, comprising:

at least one holding device according to claim 1 and at least one heating element connected to one other in a current-conductive manner.

16. The holding device according to claim 1, wherein said first holding element is held on one side of said second holding element, said deformation of said first holding element is a portion of said first holding element that protrudes from an opposite side of said second holding element and that is cold-deformed to fasten said first holding element to said second holding element.

17. The holding device according to claim 1, which further comprises a third holding element fastened to said second holding element, said third holding element configured to fasten a heating element suspended therefrom.

* * * * *